US010327054B2

(12) United States Patent
Lupfer et al.

(10) Patent No.: US 10,327,054 B2
(45) Date of Patent: Jun. 18, 2019

(54) EXTENDABLE SPEAKER SYSTEM

(71) Applicant: Clarity Design, Inc., San Diego, CA (US)

(72) Inventors: Thomas Harrison Lupfer, San Diego, CA (US); John Meredith Fox, San Diego, CA (US); Roderick Arzaga Milan, San Diego, CA (US); Alyssa Taylor Black, San Diego, CA (US); Chaney Kiana Lee Countryman, San Diego, CA (US); Orlando Crespo, San Diego, CA (US); Ronald Edwards Perranoski, San Diego, CA (US)

(73) Assignee: Clarity Design, Inc., San Diego, CA (US)

( * ) Notice: Subject to any disclaimer, the term of this patent is extended or adjusted under 35 U.S.C. 154(b) by 0 days.

(21) Appl. No.: 15/758,529

(22) PCT Filed: Sep. 9, 2016

(86) PCT No.: PCT/US2016/050931

§ 371 (c)(1),
(2) Date: Mar. 8, 2018

(87) PCT Pub. No.: WO2017/044733

PCT Pub. Date: Mar. 16, 2017

(65) Prior Publication Data

US 2018/0220212 A1 Aug. 2, 2018

Related U.S. Application Data

(60) Provisional application No. 62/216,069, filed on Sep. 9, 2015.

(51) Int. Cl.

| | |
|---|---|
| ***H04R 1/02*** | (2006.01) |
| ***H04R 1/28*** | (2006.01) |
| ***H04R 5/02*** | (2006.01) |

(52) U.S. Cl.
CPC ..... *H04R 1/02* (2013.01); *H04R 5/02* (2013.01); *H04R 1/2811* (2013.01); *H04R 2205/021* (2013.01)

(58) Field of Classification Search
CPC ..... H04R 5/02; H04R 1/2857; H04R 1/025; H04R 1/2819; H04R 1/2826;
(Continued)

(56) References Cited

U.S. PATENT DOCUMENTS 5,082,084 A * 1/1992 Ye-Ming ..... H04R 1/021 181/153
2008/0279406 A1* 11/2008 D'Hoogh ..... H04R 1/2811 381/332

(Continued)

*Primary Examiner* — Curtis A Kuntz
*Assistant Examiner* — Julie X Dang
(74) *Attorney, Agent, or Firm* — Clause Eight IPS; Michael Catania

(57) ABSTRACT

An extendable speaker system is provided with a base and lid that are connected via a plurality of concentric collapsible hollow bodies such as cylinders. A woofer speaker resides in the base. Mid range or tweeter speakers reside in the lid. The lid is displaced away from the base to expand the speaker system, where the extended cylinders provide an airtight seal between the base and lid forming a woofer speaker enclosure therein. Friction seals between the cylinders, a spring residing within the speaker enclosure, and the airtight speaker enclosure itself provide a collective force sufficient to maintain the speaker system in an extended configuration. A port is opened by depressing a button to vent the enclosure to allow for the speaker system to be collapsed. A locking system is provided to releasably maintain the speaker system in a collapsed configuration.

20 Claims, 15 Drawing Sheets

(58) Field of Classification Search
CPC .... H04R 2499/13; H04R 1/021; H04R 1/026; H04R 1/1041; H04R 1/20; H04R 1/227; H04R 1/28; H04R 1/2803; H04R 1/2807; H04R 1/2811; A63H 33/00; A63H 33/008; A63H 37/00; G10K 11/08; G10K 11/172; G10K 2200/01; G06F 1/1632
USPC ..... 381/386, 387, 182, 338, 334, 337; 181/152, 191, 193, 196, 143, 176; D14/211, 214, 221; D21/471, 398, 484
See application file for complete search history.

(56) References Cited

U.S. PATENT DOCUMENTS

2010/0146873 A1* 6/2010 Keller ..... E04H 12/182 52/111
2013/0129134 A1* 5/2013 Parraga Gimeno ..... H04R 1/02 381/338

* cited by examiner

EXTENDABLE SPEAKER SYSTEM

CROSS REFERENCE TO RELATED APPLICATION

The Present application is the United States National Stage of Patent Cooperation Treaty Application Number PCT/US2016/050931, filed on Sep. 9, 2016, which claims priority to U.S. Provisional patent Application No. 62/216,069 field on Sep. 9, 2015, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

This invention relates to the general field of audio systems, and more specifically toward an extendable speaker system.

Description of the Related Art

Speakers are considered by many to be a necessity for a variety of social functions, ranging from tailgates to wedding ceremonies. There is a demand for an appealing, portable speaker system that can play loud music with a balanced and wide frequency response.

Low frequency loudspeakers, such as a woofer or subwoofer speaker, use enclosures to prevent sound waves generated by the rearward-facing surface of the diaphragm of a speaker interacting with sound waves generated at the front of the speaker. The sound waves generated by the rearward-facing surface of a speaker are out of phase with the sound waves generated by the forward-facing surface, and therefore cause distorted sound when a listener hears both sets of sound waves. The enclosure that resides behind the speaker restricts or prevents sound waves from leaving the speaker system, thereby reducing or eliminating the sound waves that are out of phase.

There are two general types of enclosures produced for woofer speakers. A sealed enclosure provides for an airtight enclosure that reduces if not eliminates any out-of phase sound emanating from the speaker, A ported enclosure includes an opening (or port) that enables air and sound waves to pass therethough. A sealed enclosure may provide less distortion and crisper sound, but not provide the same "thunder" or "roar" as a ported enclosure. The airtight sealed enclosure acts as a type of shock absorber that restricts large displacements of the cone of the speaker. The ported enclosure removes the shock absorber effect, but does allow some sound to escape. This out of phase sound emanating from the enclosure can lead to an overall distorted sound to the user.

To mitigate the effects of the shock absorbing sealed enclosure, the sealed enclosure can be made larger. A larger sealed enclosure provides for smaller pressure changes resulting from the displacement of the cone of the speaker. Smaller pressure changes in the sealed enclosure allow for a greater displacement of the cone of the speaker, while reducing or preventing out of phase sound waves from leaving the speaker system. Larger ported enclosures are also beneficial over smaller ported enclosures, as the larger ported enclosures are able to trap and dissipate the out of phase sound more effectively than smaller sized ported enclosures.

Providing a large enclosure for a woofer speaker results in a large, often cumbersome, unit that is difficult to transport. Smaller sealed speaker enclosures, while easier to transport, don't provide the rich, tight sound at lower frequencies. Prior art speaker systems have tried to overcome these difficulties by providing inflatable sealed enclosures, or enclosures with flexible walls. However, these systems can be easily broken (punctured), don't expand to multiple times their collapsed size, or don't provide high quality sound at a wide range of frequencies.

Thus there has existed a long-felt need for a speaker system that provides high quality audio with a wide frequency response, including low frequencies, that can collapse to a small size for transport and storage, and expand to multiple times its collapsed size to provide a larger speaker enclosure.

BRIEF SUMMARY OF THE INVENTION

An extendable speaker system is provided with a base and lid that are connected via a plurality of concentric collapsible hollow bodies such as cylinders. A woofer speaker resides in the base. Mid range or tweeter speakers reside in the lid. The lid is displaced away from the base to expand the speaker system, where the extended cylinders provide an airtight seal between the base and lid forming a woofer speaker enclosure therein. Friction seals between the cylinders, a spring residing within the speaker enclosure, and the airtight speaker enclosure itself provide a collective force sufficient to maintain the speaker system in an extended configuration. A port is opened by depressing a button to vent the enclosure to allow for the speaker system to be collapsed. A locking system is provided to releasably maintain the speaker system in a collapsed configuration.

The current invention provides just such a solution by having an extendable speaker system with a base and lid that are connected via a plurality of concentric collapsible hollow bodies such as cylinders. A woofer speaker resides in the base. Mid range or tweeter speakers reside in the lid. The lid is displaced away from the base to expand the speaker system, where the extended cylinders provide an airtight seal between the base and lid forming a woofer speaker enclosure therein. Friction seals between the cylinders, a spring residing within the speaker enclosure, and the airtight speaker enclosure itself provide a collective force sufficient to maintain the speaker system in an extended configuration. A port is opened by depressing a button to vent the enclosure to allow for the speaker system to be collapsed. A locking system is provided to releasably maintain the speaker system in a collapsed configuration.

It is an object of the invention to provide an extendable and expandable speaker system that expands to multiple times its collapsed size.

It is another object of the invention to provide an extendable speaker system with a sealed enclosure for a woofer speaker.

It is a further object of this invention to provide extendable speaker system that produces high quality audio over a wide range of frequencies, including low frequencies.

A particular embodiment of the current disclosure is an extendable speaker system comprising a base, a lid, and a plurality of concentric collapsible hollow bodies; where the base comprises a speaker; where the lid comprises a plurality of speakers; where the plurality of concentric collapsible hollow bodies form an enclosure above the speaker of the base and beneath the lid; where the plurality of concentric hollow bodies is extendable to separate the lid from the base thereby providing for an extended configuration, and where the plurality of concentric hollow bodies is collapsible to unite the lid with the base thereby providing for a collapsed configuration. The plurality of concentric hollow bodies is a plurality of concentric cylinders. Each of the plurality of concentric hollow bodies is a rigid body. The enclosure is a sealed enclosure. The base comprises a plurality of magnets, wherein the lid comprises a plurality of magnets, where the plurality of magnets for the base mate with the plurality of magnets of the lid when the extendable speaker system is in a collapsed configuration. The speaker of the base is a speaker with a diameter of at least four inches. The speaker of the base faces downward. The base comprises a plurality of holes. The lid comprises a plurality of holes. Each of the plurality of speakers of the lid have a diameter of two inches or less. Each of the plurality of speakers of the lid has an upward angle of between ten degrees and thirty degrees, inclusive, from the horizontal. Each of the plurality of speakers of the lid are offset by ninety degrees from each other. The lid comprises an interface for interacting with the speaker system. Each of the plurality of hollow bodies has a lower external diameter and an upper external diameter, where the lower external diameter of each hollow body is greater than the upper external diameter of that same hollow body. The extendable speaker system further comprises a spring, where the spring is within the enclosure. One end of the spring is attached to the base, and where the other end of the spring is attached to the lid. The extendable speaker system further comprises a cable, where the cable is within the enclosure, and where the cable extends from the base to the lid. The cable is attached to the spring at multiple locations. The lid further comprises a port, where the port provides fluid access through the lid to the enclosure. The lid further comprises a button, shaft, spring, and flange, where the button extends beyond a top surface of the lid, where the shaft is secured to the button on a first end, where the flange is secured to the shaft on a second end, where the spring surrounds the shaft, and where the flange releasably seals the port.

Another embodiment of the current disclosure is an extendable speaker system comprising a base, a lid, and a plurality of concentric collapsible hollow bodies, and a spring; where the base comprises a speaker; where the lid comprises a speaker and a port, where the port provides fluid access through the lid to the enclosure; where the plurality of concentric collapsible hollow bodies form a sealed enclosure above the speaker of the base and beneath the lid, where the spring is within the enclosure, and where each of the plurality of concentric hollow bodies is a rigid body; and where the plurality of concentric hollow bodies is extendable to separate the lid from the base thereby providing for an extended configuration, and where the plurality of concentric hollow bodies is collapsible to unite the lid with the base thereby providing for a collapsed configuration. The plurality of concentric hollow bodies is a plurality of concentric cylinders. Each of the plurality of concentric hollow bodies comprises a lower lip and an upper lip, where the lower lip of each of the plurality of concentric hollow bodies extends outward, and where the upper lip of each of the plurality of concentric hollow bodies extends inward. The base comprises a plurality of magnets, wherein the lid comprises a plurality of magnets, where the plurality of magnets for the base mate with the plurality of magnets of the lid when the extendable speaker system is in a collapsed configuration. The base comprises a plurality of holes. The lid comprises a plurality of holes. Each of the plurality of hollow bodies has a lower external diameter and an upper external diameter, where the lower external diameter of each hollow body is greater than the upper external diameter of that same hollow body. One end of the spring is attached to the base, and where the other end of the spring is attached to the lid. The extendable speaker system further comprises a cable, where the cable is within the enclosure, and where the cable extends from the base to the lid. The cable is attached to the spring at multiple locations. The lid further comprises a button, shaft, spring, and flange, where the button extends beyond a top surface of the lid, where the shaft is secured to the button on a first end, where the flange is secured to the shaft on a second end, where the spring surrounds the shaft, and where the flange releasably seals the port.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
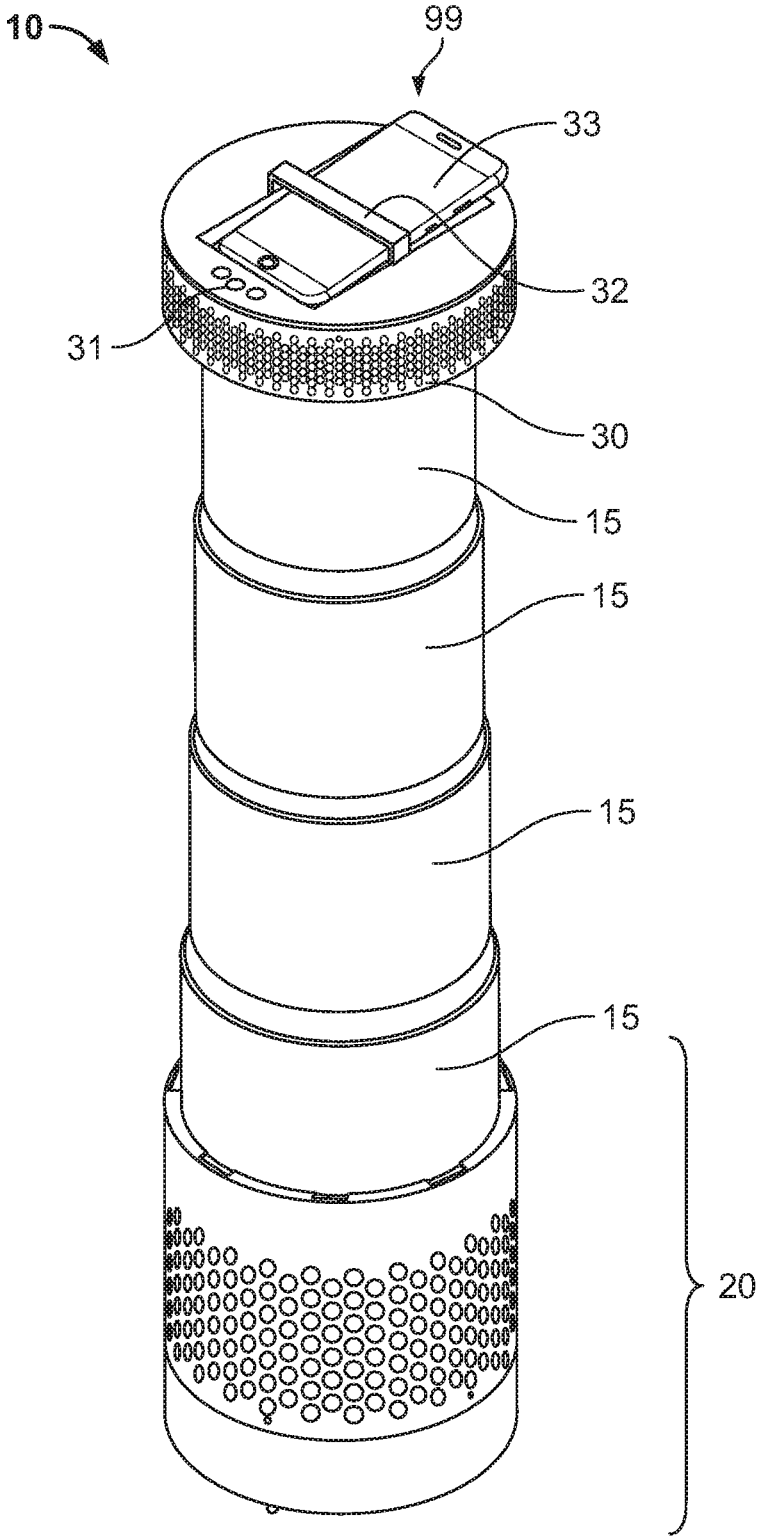
FIG. 1 is a perspective view of the speaker system in an extended configuration according to select embodiments of the current disclosure.

FIG. 1 is a perspective view of the speaker system in an extended configuration according to select embodiments of the current disclosure. The speaker system 10 has a lid 30 and base 20. A plurality of concentric collapsible hollow bodies, in this instance coaxially aligned cylinders 15, connects the lid 30 to the base 20. In this view, there are four cylinders 15 shown in an extended configuration. The lid 30 includes a handle 32 for carrying and extending/collapsing the speaker system 10. A mobile phone 99 is shown resting in a phone slot 33. Controls for interacting with the speaker system 10 are provided through an interface 31, such as a power button and volume up and down buttons.

Figure 2:
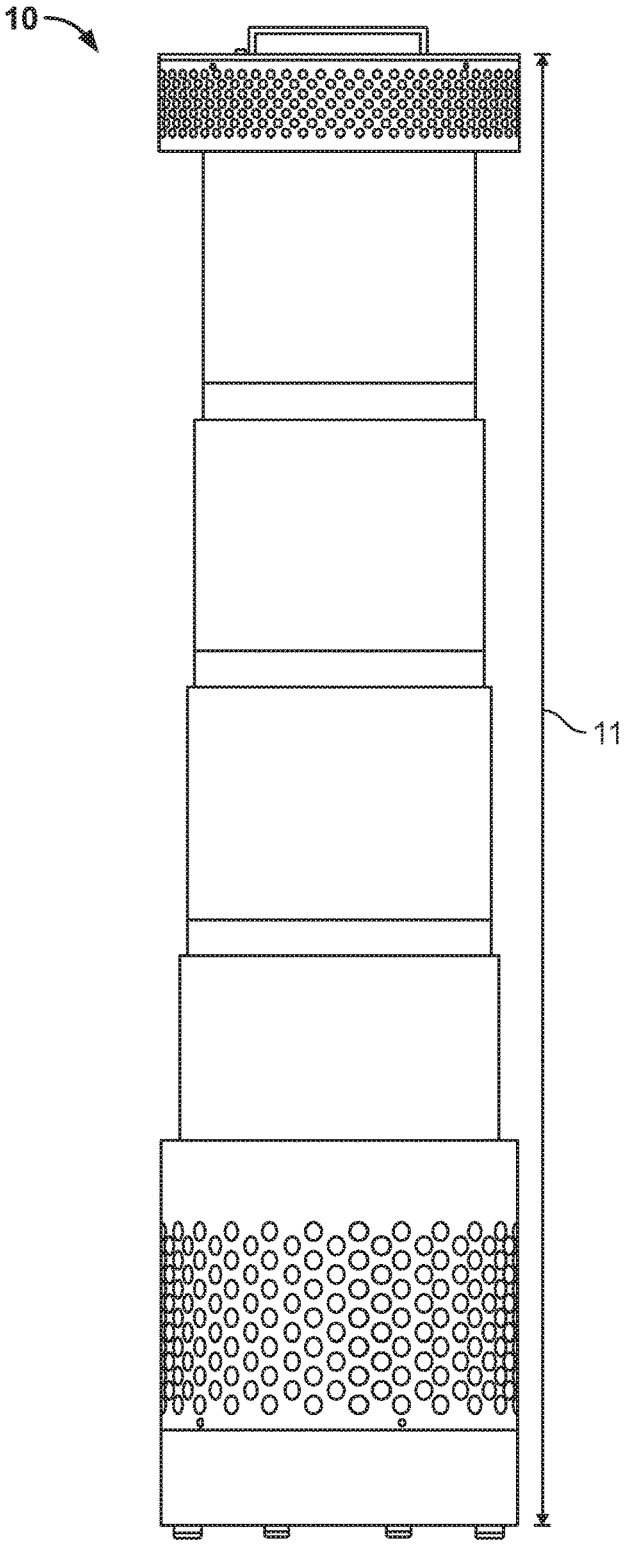
FIG. 2 is a side view of the speaker system in an extended configuration according to select embodiments of the current disclosure.
Figure 3:
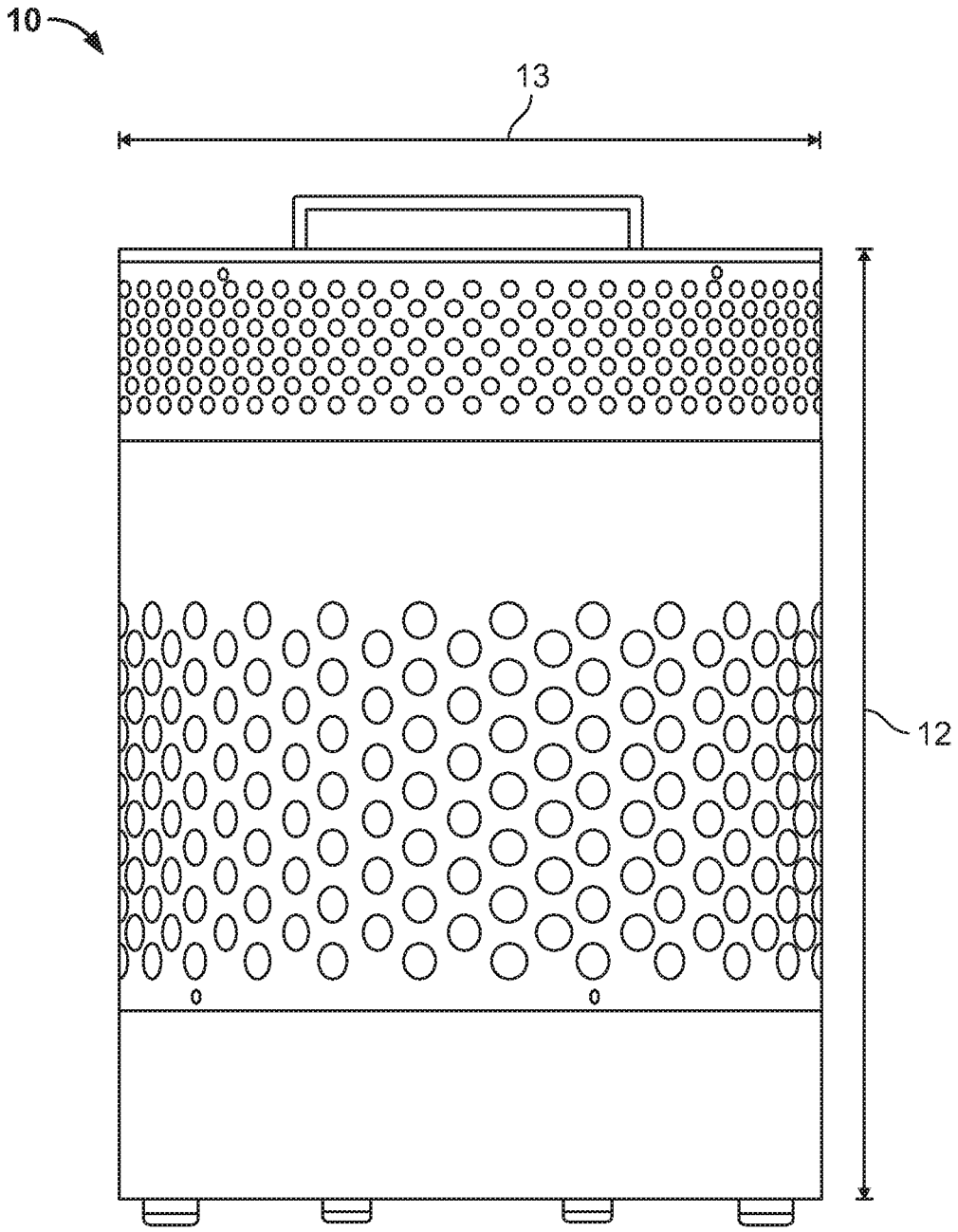
FIG. 3 is a side view of the speaker system in a collapsed configuration according to selected embodiments of the current disclosure.

FIG. 2 is a side view of the speaker system in an extended configuration according to select embodiments of the current disclosure. FIG. 3 is a side view of the speaker system in a collapsed configuration according to selected embodiments of the current disclosure. The speaker system has an extended height 11 of thirty-three inches (33") tall and a collapsed height 12 of eleven inches (1"). Its largest outer diameter 13 is seven and one-half inches (7.5") where in an extended or collapsed configuration. The lid 30 is two inches (2") tall when viewed from the outside.

Figure 4:
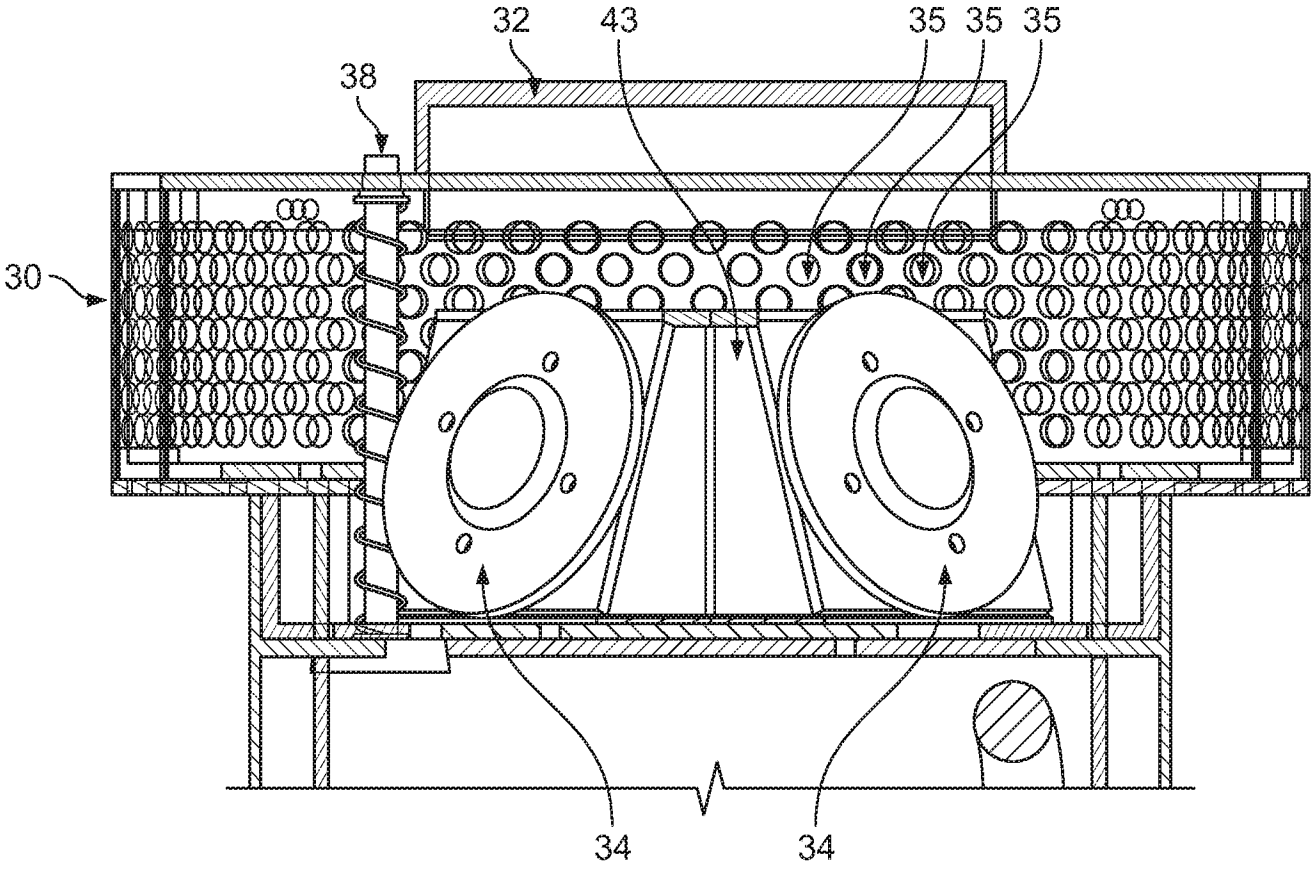
FIG. 4 is a cutaway front view of a top portion of the speaker system according to selected embodiments of the current disclosure.

FIG. 4 is a cutaway front view of a top portion of the speaker system according to selected embodiments of the current disclosure. There are two two-inch (2") mid range speakers 34 inside the lid 30. Drivers of this size are fairly inexpensive and together can reach ninety decibels (90 dB). Mid-range speakers of this size typically have a frequency range from three-hundred hertz (300 Hz) to twenty kilohertz (20 kHz). Sound emanating from the mid range speakers 34 may pass through holes 35 in the outer portion of the lid 30. A handle 32 extends from the top of the lid 30. An air-seal button 38, discussed in more detail below, extends at least partially through the top surface of the lid 30. Each mid range speaker 34 is secured to a mid range speaker enclosure 43. The enclosure 43, in this particular embodiment a sealed enclosure, performs a similar function to the enclosure for the woofer speaker; however, it can be significantly smaller because of the higher minimum frequencies produced by the mid-range speakers.

Figure 5:
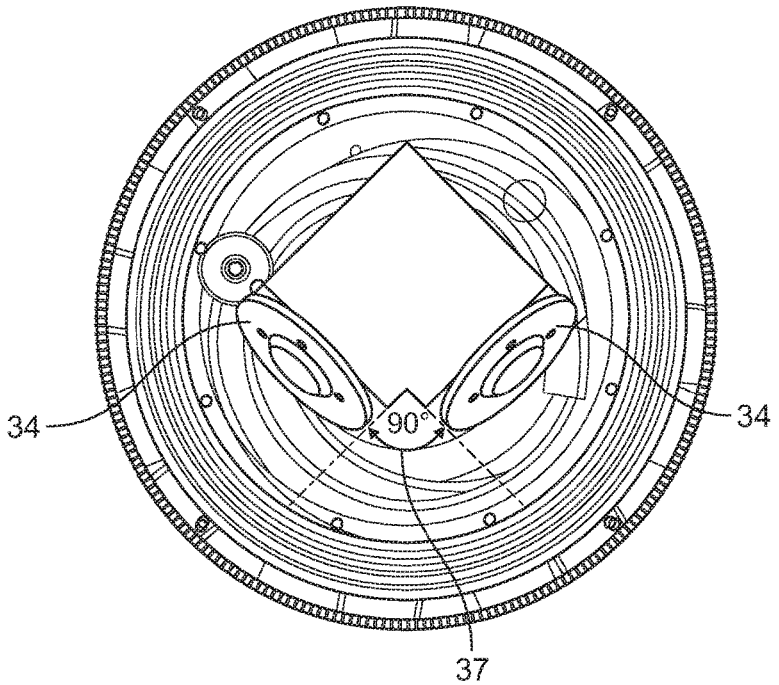
FIG. 5 is a cutaway top view of the lid of the speaker system according to selected embodiments of the current disclosure.

FIG. 5 is a cutaway top view of the lid of the speaker system according to selected embodiments of the current disclosure. The mid range speakers 34 have a horizontal offset 37 if ninety degrees (90°) relative to each other. This orientation gives the mid range speakers 34 more directionality while still being able to cover a very large field. In this configuration, the mid range speakers can easily cover a two-hundred-ten degree (210°) field loudly.

Low frequency sounds emitted by the woofer speaker are generally omni-directional; the listener is often unable to discern what direction the low-frequency sound is coming from.

Therefore, having a single woofer speaker is sufficient. However, the middle and high frequency sounds emitted by the mid range speakers are more directional. The middle and high frequencies are separated from the low frequencies. The middle and high frequencies are only sent to the elevated mid range speakers. A stereo effect is achieved by providing a left channel to one speaker (the left speaker), and a right channel to another speaker (the right speaker). Baffles in the lid may be used to help separate the sounds emanating from each speaker to help increase the stereo effect, A switch is integrated into the lid to enable users to select between stereo and mono sound. When the switch selects stereo sound, left and right audio channels are sent to the left and right mid range speakers, respectively. When the switch selects mono sound, the left and right audio channels are combined, and the combined signal is sent to each mid range speaker. The switch may be selected by various means, including a mechanical switch such as a toggle switch or button, a remote control, or an app on a smart phone. In this manner, a user may select whether stereo or mono sound is emitted from the speaker system.

Figure 6:
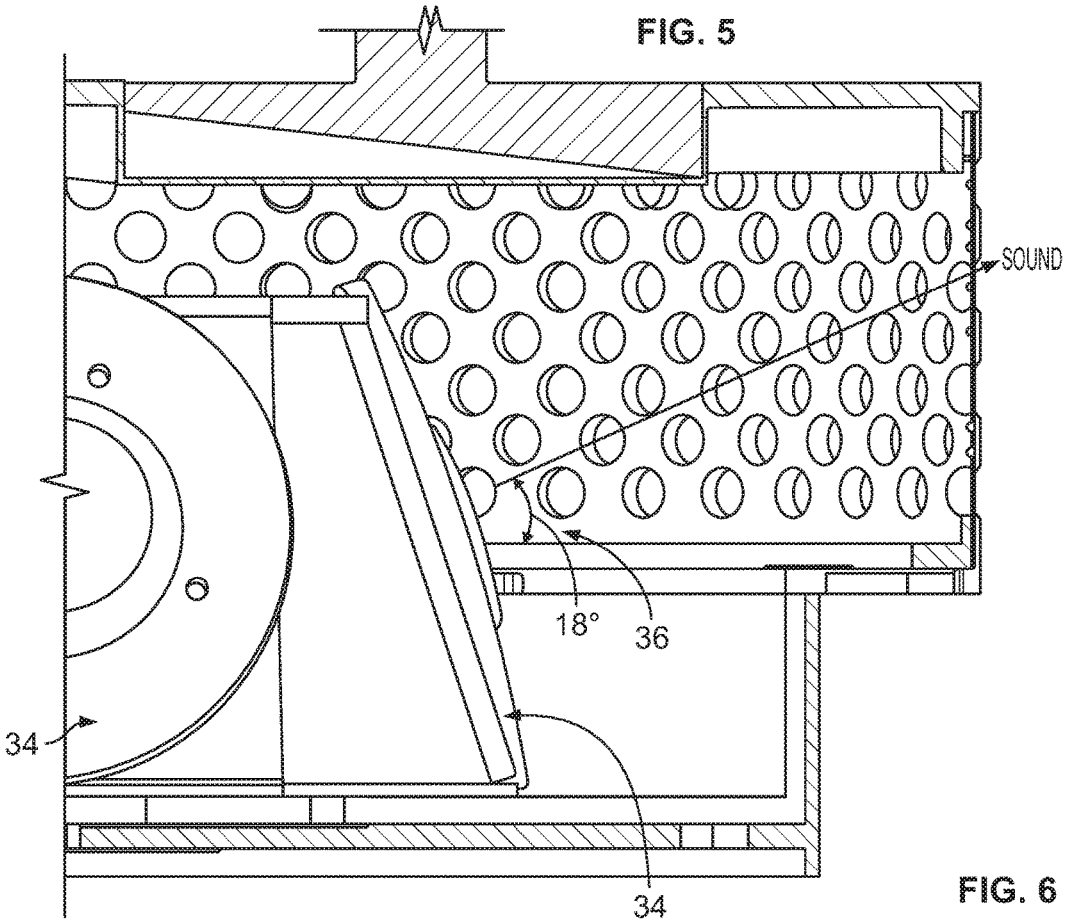
FIG. 6 is a partial cutaway side view of the lid of the speaker system according to selected embodiments of the current disclosure.

FIG. 6 is a partial cutaway side view of the lid of the speaker system according to selected embodiments of the current disclosure. The mid range speakers 34 have an upward angle 36 eighteen degrees (18°) from the horizontal such that sound emanating from the mid range speakers is aimed up toward the listener's ears, though angles of between ten degrees (10°) and thirty degrees (30°), inclusive, are contemplated. This configuration allows sufficient volume from the mid range speakers 34 to reach the ear of the listener without the speaker system needing to be six feet tall.

Figure 7:
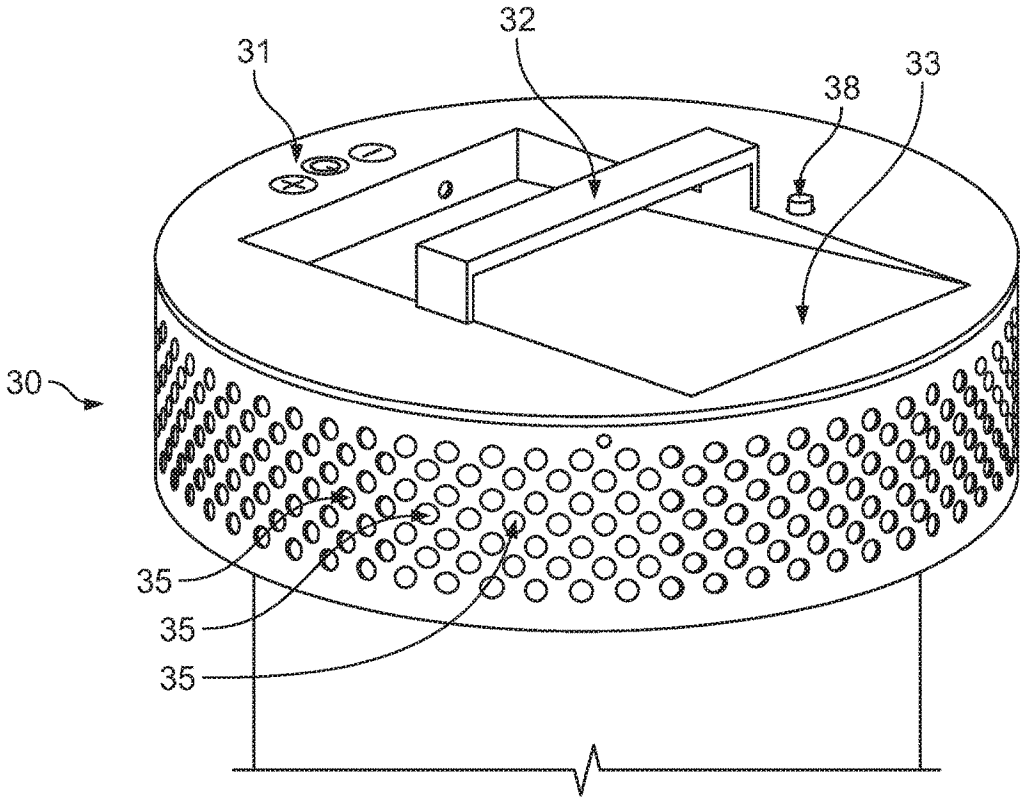
FIG. 7 is a perspective view of the lid of the speaker system according to selected embodiments of the current disclosure.
Figure 8:
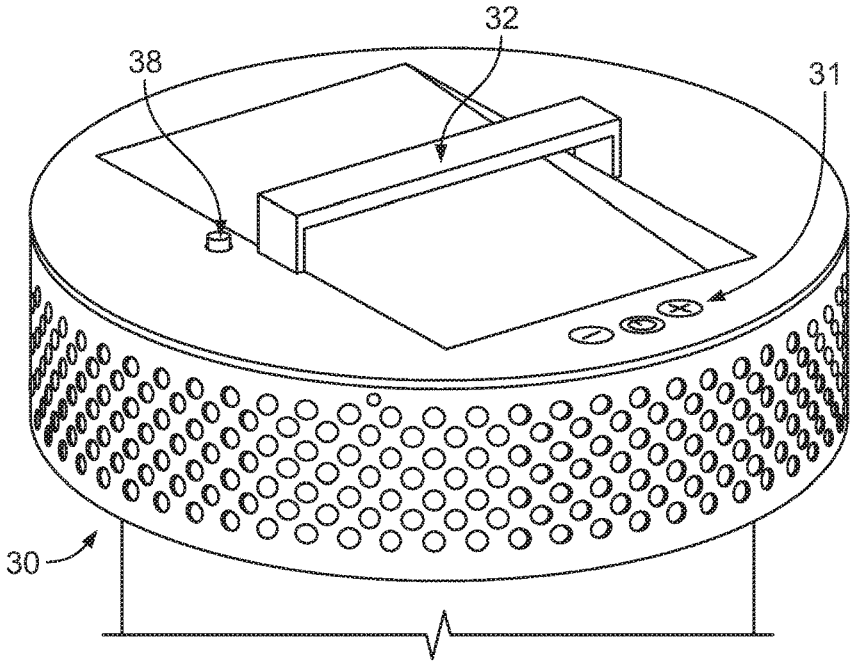
FIG. 8 is a perspective view, opposite of that in FIG. 7, of the lid of the speaker system according to selected embodiments of the current disclosure.

FIG. 7 is a perspective view of the lid of the speaker system according to selected embodiments of the current disclosure. FIG. 8 is a perspective view, opposite of that in FIG. 7, of the lid of the speaker system according to selected embodiments of the current disclosure. The handle raises six-tenths of an inch (6/10") above the top surface of the lid 30. The phone slot 33 is shown angled towards the interface 31, which is towards the front of the speaker system. These elements help indicate the orientation of the speaker system to enable users to direct the speaker system towards its intended audience. The lid 30 has holes 35 around its outer surface to allow for sound to pass therethrough. There should be a sufficient number of holes 35 to provide an open area for sound to escape, while using smaller holes 35 so that no large objects can penetrate the lid 30, An air-seal button 38 protrudes at least partially through the top surface of the lid 30, and is discussed in more detail below.

Figure 9:
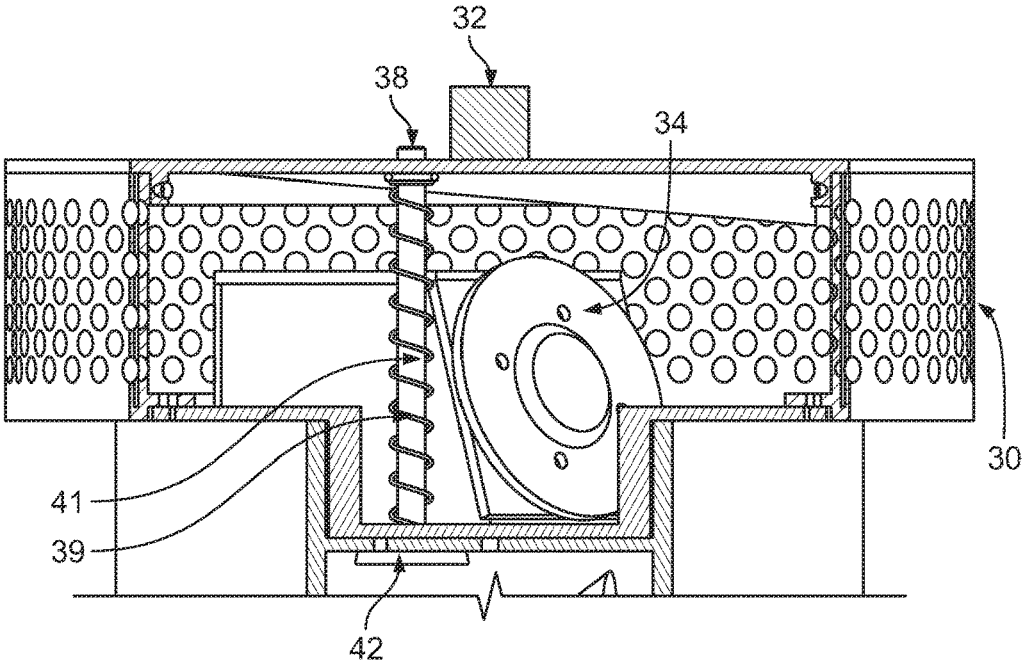
FIG. 9 is a cutaway side view of the lid of the speaker system according to selected embodiments of the current disclosure.

FIG. 9 is a cutaway side view of the lid of the speaker system according to selected embodiments of the current disclosure. The air-seal button 38 seals (or unseals) the cylinder enclosure. The air-seal button 38 extends beyond the top surface of the lid 30, The air-seal button 38 is connected to a shaft 41. Around the shaft 41 is a spring 39. A flange 42 is affixed at the opposite end of the shaft 41 from the air-seal button 38. The flange 42 seals the cylinder enclosure by closing a port that connects the cylinder enclosure with the inner compartment of the lid 30. When the air-seal button 38 is depressed, the flange 42 uncovers the port thereby allowing air to pass therethrough.

The cylinder enclosure, when the speaker system is in an extended configuration, is a sealed enclosure for a woofer or subwoofer speaker, discussed in more detail below. The air-seal button enables the cylinder enclosure to releasably vent. This is important not only for sound quality (sealed enclosure), but also to lock the system in its extended configuration. The air-seal button extends into the enclosure space below the lid and through a small hole or port into the cylinder enclosure. When the button is not pressed, the port is sealed by the flange due to the spring force. This will allow for higher quality audio performance by having a tight seal. When the button is depressed, the hole in the lid will not be sealed and therefore open the enclosure to air. This allows for air to escape the enclosure when collapsing the system.

Figure 10:
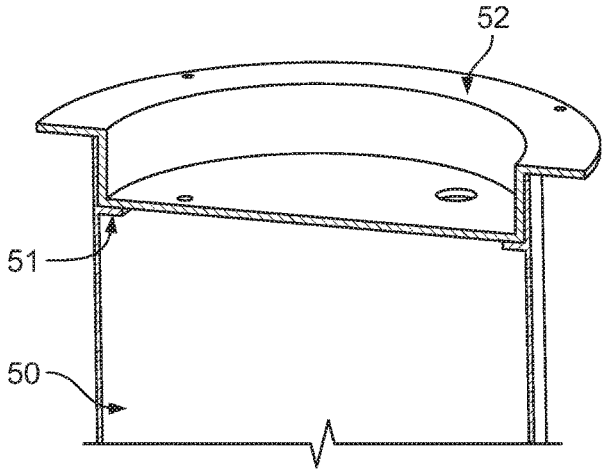
FIG. 10 is a cutaway side perspective view of the innermost cylinder and base of the lid of the speaker system according to selected embodiments of the current disclosure.

FIG. 10 is a cutaway side perspective view of the innermost cylinder and base of the lid of the speaker system according to selected embodiments of the current disclosure. In order to create more space within the lid while simultaneously making the lid shorter, the new lid portion extends down into the first cylinder. The lower extension is necessary because the mid range speakers are about two inches to three inches at their largest diameter. With an outer lid portion that is two inches tall, there would be insufficient space for the speakers. There would also be no room for a phone slot without the base of the lid extending downwards below the lowermost point of the outer surface of the lid. Furthermore, the lower extension also allows for the mid range speakers to be tilted upward at eighteen degrees (18°), as discussed above, and not have the sound emanating from these speakers reflect off the top of the lid. The base of the lid 52 extends downwards into the innermost cylinder 50 and mates with a lip 51. The lip 51 supports the bottom of the base of the lid 52.

Figure 11:
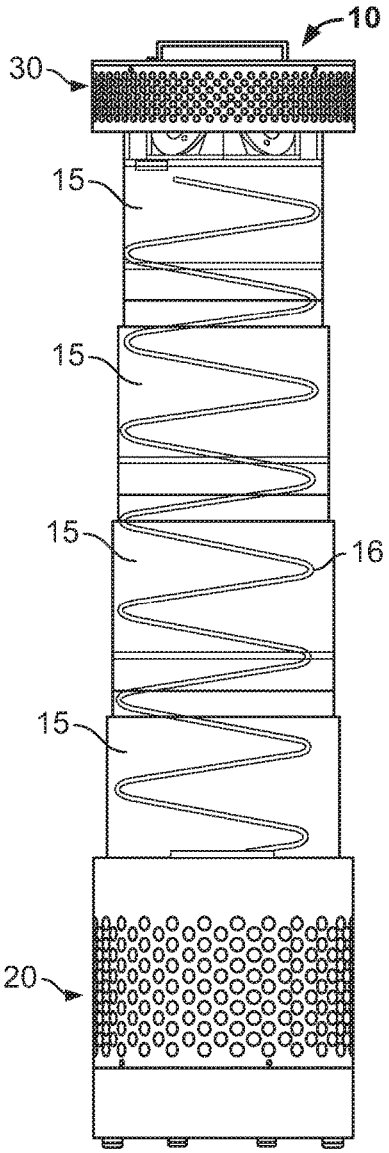
FIG. 11 is a semi-transparent side view of the speaker system in an extended configuration according to selected embodiments of the current disclosure.

FIG. 11 is a semi-transparent side view of the speaker system in an extended configuration according to selected embodiments of the current disclosure. The extension mechanism uses a combination of friction between concentric cylinders 15 and a spring 16. The extension mechanism allows for the system to extend to a height that is many times the height of its collapsed configuration. Four concentric cylinders 5 are used to provide a rigid enclosure behind the woofer. The cylinders 15 are made of durable rigid plastic so that sound quality, cost and durability are all satisfied. In a particular embodiment, the nominal diameters of these cylinders 15 are about six inches (6"). The four cylinders 15 are located between the base 20 and the lid 30. A spring 16 resides within the space provided for by the four cylinders 15. The spring 16 applies a force to the speaker system 10 that pushes the lid 30 away from the base 20. As the speaker system 10 is collapsed, where the lid 30 is displaced towards the base 20, the force applied by the spring 16 increases. Furthermore, as the speaker system 10 is collapsed, the concentric cylinders 15 slide within one another.

The spring 16 serves multiple functions of self-lifting (outward force between the lid 30 and the base 20), aid in locking, and aligning the speaker system 10. The compressed force of the spring 16, in a particular embodiment, provides seven pounds (7 lbs) of force, which is able to self-extend the speaker system 10, at least partially. The spring 16 helps to lock the speaker system in an extended configuration by providing, in a particular embodiment, three pounds (3 lbs) of force upwards on the lid after fully extended. Modifying the force of the spring 16 is contemplated to provide either more force or less, thereby making the system easier or more difficult to expand or collapse. The spring 16 is able to slightly rotate, but resists over rotation, which allows for lock/unlocking by minor rotation using magnet locks (described in more detail below), a natural alignment, and no over rotation of wires. Particular embodiments provide for a spring that is about one-eight of an inch (⅛") thick and has eight coils. The diameter of the spring matches the size of the cylinders so that there is no buckling. The spring is made of common spring metals, such as steel, copper, bronze, and titanium. The spring 16 attaches to the base of the lid 30 at one end and the woofer plate (not shown) within the base 20 on the other.

In another embodiment, the speaker system is provided without a spring within the concentric cylinders enclosure. Such an embodiment relies on the friction seals between each cylinder as well as the internal pressure of the sealed system to maintain the speaker system in an extended configuration.

Figure 12:
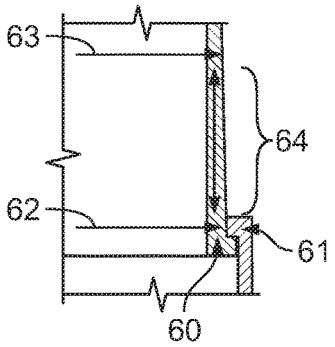
FIG. 12 is a partial cutaway side view of two cylinders of the speaker system according to selected embodiments of the current disclosure.

FIG. 12 is a partial cutaway side view of two cylinders of the speaker system according to selected embodiments of the current disclosure. Friction between the cylinders is used to seal the sides of the enclosure. Each cylinder end will slightly increase in diameter in order to create a friction seal with the next cylinder. In other words, the lower diameter 62 of each cylinder is greater than its upper diameter 63, All cylinders will also have a small lower lip 60 and an upper lip 61 to prevent any cylinders from sliding past one another. When the speaker system is in an extended configuration, the lower lip 60 of one cylinder mates with the upper lip 61 of an adjacent cylinder, thereby preventing further extension of the cylinders. In a particular embodiment, there is an external slant or angle 64 of around two degrees (2°).

Figure 13:
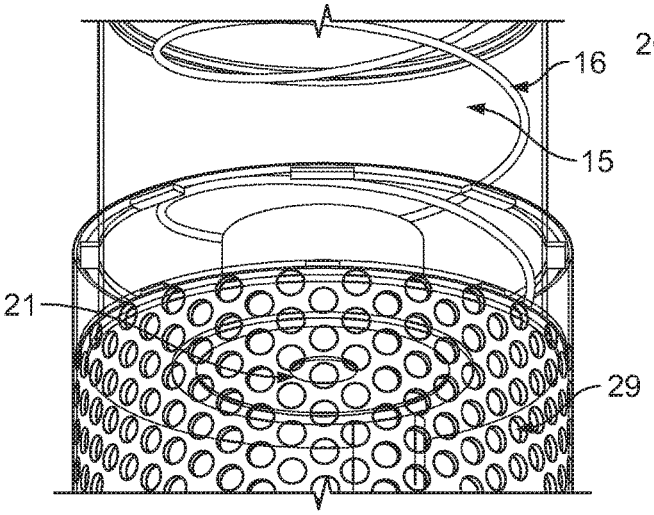
FIG. 13 is a semi-transparent partial side perspective view of the lower portion of the speaker system according to selected embodiments of the current disclosure.

FIG. 13 is a semi-transparent partial side perspective view of the lower portion of the speaker system according to selected embodiments of the current disclosure. A four inch (4") woofer 21 faces downward, where the volumetric space within the cylinders 15 act as its enclosure. When the speaker system is in the extended configuration, the woofer 21 is raised up by four and one-half inches (4.5") as compared to when the speaker system is in the collapsed configuration, in order to raise it above holes 29 in the base housing so that sound can escape. A spring 16 is shown extending upwards from the woofer 21. This end of the spring 16 is secured to the woofer plate (not clearly shown in this figure).

Woofers with a diameter of around four inches (4") can have frequency responses from 50 Hz to 2 kHz, are widely available and relatively inexpensive. These speakers are also much lighter than larger diameter woofers. A typical weight is about one-half (½) to two (2) pounds. The smaller diameter also allows for the speaker system to be much thinner, and allows for a speaker system with a cross-sectional diameter of seven and one-half inches (7.5"). Subwoofer speakers, which will have a lower frequency response, may be used in place of the woofer speaker; however subwoofer speakers are generally larger in size and would require a larger diameter speaker system.

Figure 14:
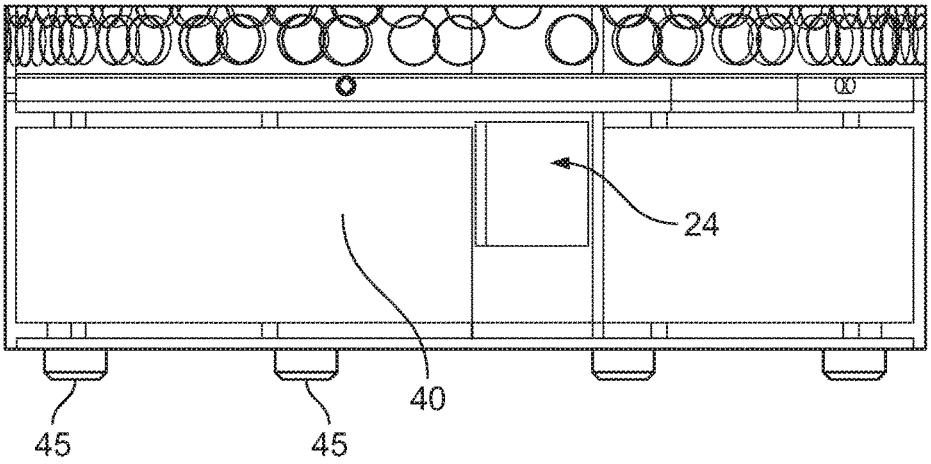
FIG. 14 is a semi-transparent side view of the lower portion of the base of the speaker system according to selected embodiments of the current disclosure.

FIG. 14 is a semi-transparent side view of the lower portion of the base of the speaker system according to selected embodiments of the current disclosure. The electronics compartment located in the lower portion of the base is less than two inches (2") tall in order to make the collapsed system shorter. If a height of two inches for the electronics compartment 40 does not include enough volume for the electronic components, then the space can be extended. However this increase in height of the electronics compartment will in turn increase the collapsed height of the system. The electronics compartment holds electrical systems including without limitation batteries, an audio amplifier, and a passive crossover. The batteries, depending on their shape and size, may have to be laid on their sides in order to fit. A crossover of 300 Hz is proposed due to the ability of the mid range speakers' frequency response. Wires from the electronic components that lead to other portions of the speaker system, such as the mid-range speakers, interface, and audio connection, exit through a wire entrance 23 (labeled as a wire exit in this figure). A plurality of feet 45 are affixed to the bottom of the base to at least slightly elevate the speaker system above whatever surface it rests upon.

Figure 15:
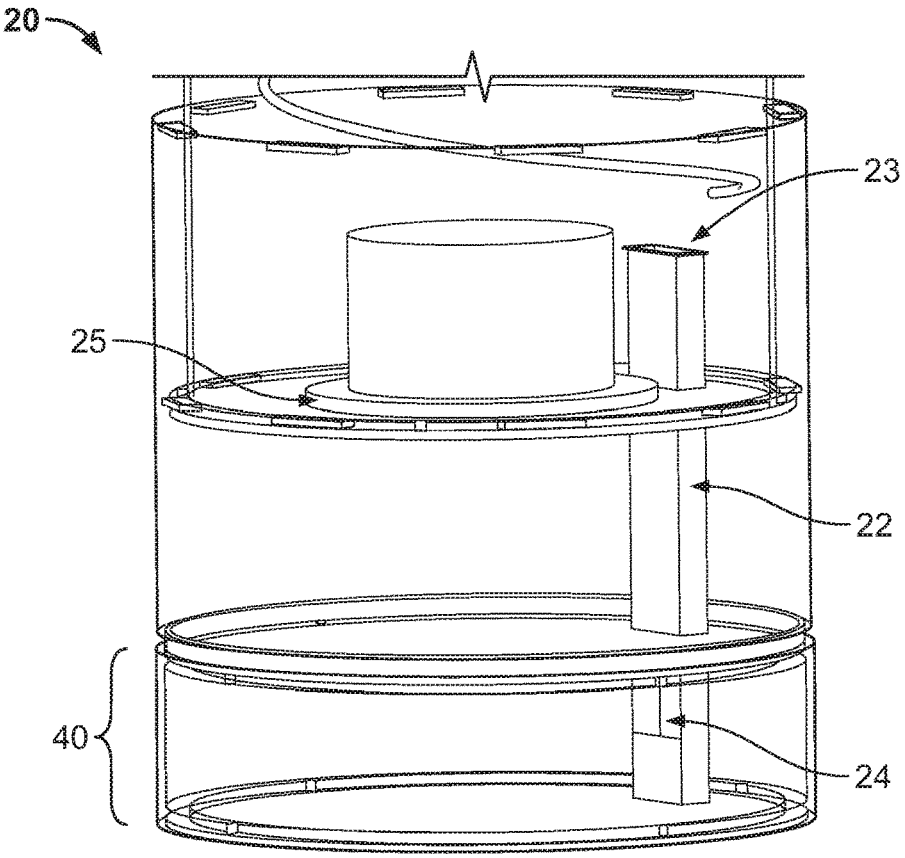
FIG. 15 is semi-transparent side view of the lower portion of the speaker system according to selected embodiments of the current disclosure.

FIG. 15 is semi-transparent side view of the lower portion of the speaker system according to selected embodiments of the current disclosure. A tube 22 protruding from the electronic compartment 40 will guide wires into the cylinder enclosure above. The woofer is attached to a woofer plate 25 and slides upward and downward along the length of the tube 22 in order to be lifted and lowered. Wires travel from the electronics compartment 40 to other sections of the speaker system through the wire tube 22. Wires enter the wire tube 22 from the electronics compartment through a wire entrance 24. Wires then exit through the top of the wire tube 22 through a wire exit 23. Above the wire tube 22, two wires will run to the woofer. Other wires need to be guided to the lid for the user interface and mid ranges. These wires are wrapped together as a cable, discussed in more detail below.

Figure 16:
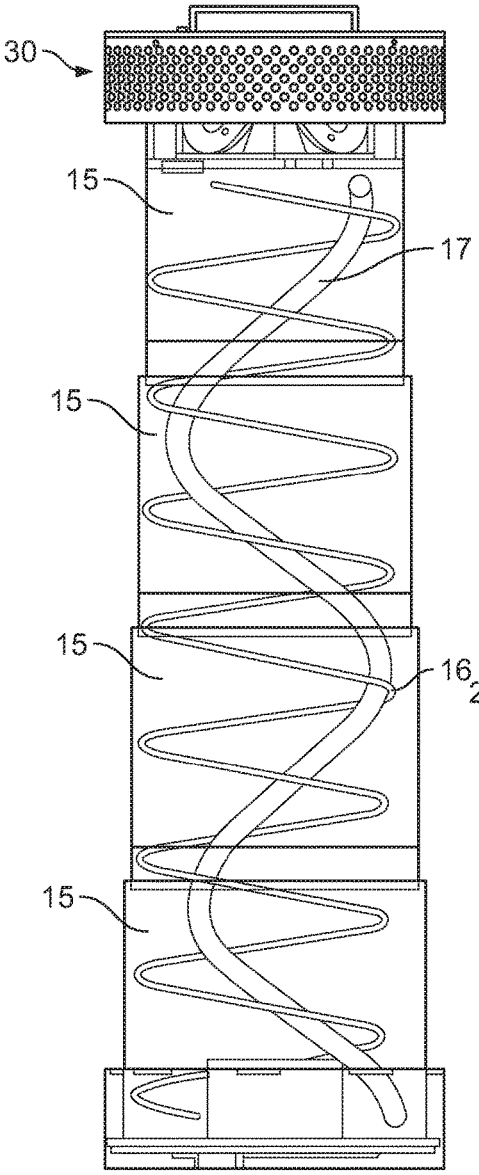
FIG. 16 is a semi-transparent side view of the lid and cylinders of the speaker system in an extended configuration according to selected embodiments of the current disclosure.

FIG. 16 is a semi-transparent side view of the lid and cylinders of the speaker system in an extended configuration according to selected embodiments of the current disclosure. Wires that leave the wire tube of the base are wrapped together to form a single cable 17. The cable 17 follows a helical pattern within the cylinders 15 up to the lid 30. The cable will attach to the spring 16 in various places in order to follow a helical path that will not become tangled or obstruct anything. As the spring 6 compresses, the cable 17 will also compress with it. As the spring 16 extends, the cable 17 will also extend.

Figure 17:
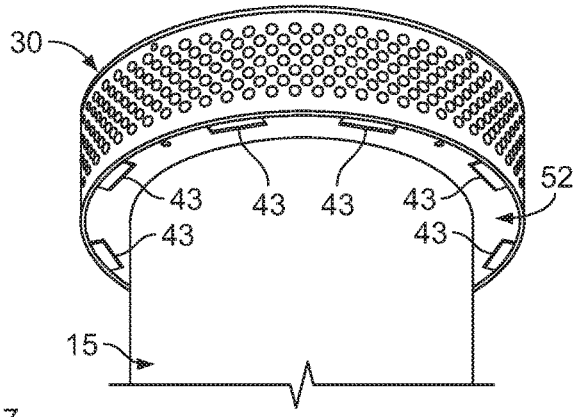
FIG. 17 is a lower perspective view of the lid and innermost cylinder of the speaker system in an extended configuration according to selected embodiments of the current disclosure.
Figure 18:
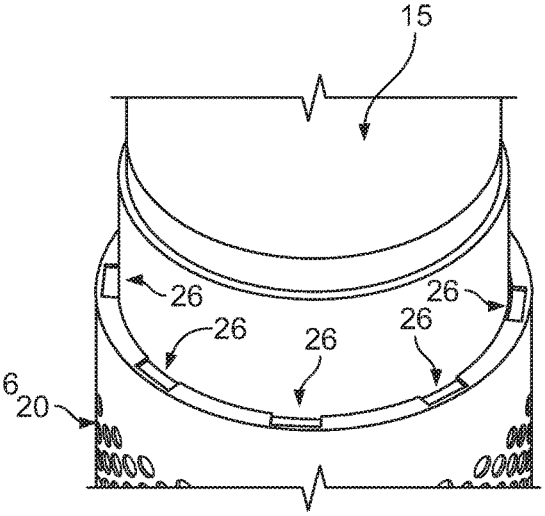
FIG. 18 is a perspective view of a portion of the base and outermost cylinder of the speaker system in an extended configuration according to selected embodiments of the current disclosure.
Figure 19:
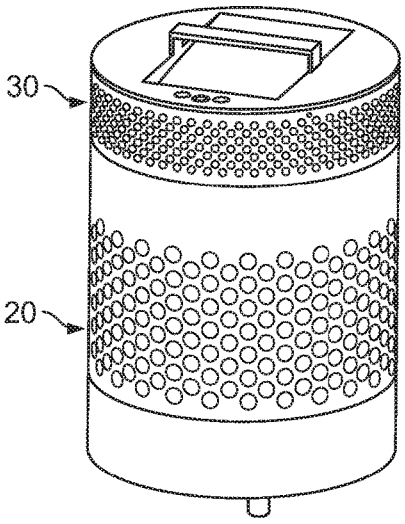
FIG. 19 is a perspective view of the speaker system in a collapsed configuration according to selected embodiments of the current disclosure.

FIG. 17 is a lower perspective view of the lid and innermost cylinder of the speaker system in an extended configuration according to selected embodiments of the current disclosure. FIG. 18 is a perspective view of a portion of the base and outermost cylinder of the speaker system in an extended configuration according to selected embodiments of the current disclosure. FIG. 19 is a perspective view of the speaker system in a collapsed configuration according to selected embodiments of the current disclosure. A locking mechanism is used to maintain the speaker system in a collapsed configuration; otherwise the force of the spring may cause the speaker system to expand. The lock keeps the lid 30 attached to the base (not shown in this figure) when the system is in its collapsed state. This lock uses sixteen (16) magnets. Using magnets makes engaging the lock very easy. It is also simple and inexpensive to incorporate into the speaker system. Magnets 43 are placed around the bottom of the lid 30, Magnets 26 are also placed around the top of the base 20. The magnets 43 of the lid 30 mate with the magnets 26 of the base 20. If the speaker system as a whole is spun, the magnets 43 of the lid 30 and the magnets 26 of the base 20 do not disengage and the speaker system remains locked since the entire speaker system spins together. To disengage the locks and displace the magnets 43 of the lid 30 from the magnets 26 of the base 20, a user places the speaker system on a surface, such as the floor, and rotates or spins the lid 30. Since the base 20 is in contact with the floor, frictional forces between the base 20 and the floor restrict rotational movement. This allows the lid 30 magnets 43 and base 20 magnets 26 to overcome their attractive forces and come out of alignment. Note that without any external forces acting upon the speaker system, the magnets 43 and magnets 26 are naturally aligned due to the alignment of the spring within the cylinders 15. Therefore, to engage the base 20 magnets 26 and lid 30 magnets 43 and lock the speaker system, the user applies a downward force on the lid 30 until the lid 30 and base 20, and therefore the lid 30 magnets 43 and base 20 magnets 26, mate together. The speaker system locked in a collapsed configuration is shown in FIG. 19.

While the spring alone may be sufficient to maintain rotational alignment of the speaker system, lips may be incorporated into the cylinders, base, and lid to allow only a limited amount of rotation. Over rotation of the speaker system can result in inelastic deformation of the spring, where the spring is permanently damaged. Thus, it may be desirable to implement physical limitations to prevent over rotation of the speaker system. For example, a lip from the innermost cylinder can mate with the lip from the lid once the lid has been rotated a sufficient amount relative to the base. After the lips mate, further rotation is prevented. A similar mechanism may be incorporated between the outermost cylinder and the base. In this fashion, over rotation of the speaker system, which could potentially damage the spring through inelastic deformation, can he avoided.

Figure 20:
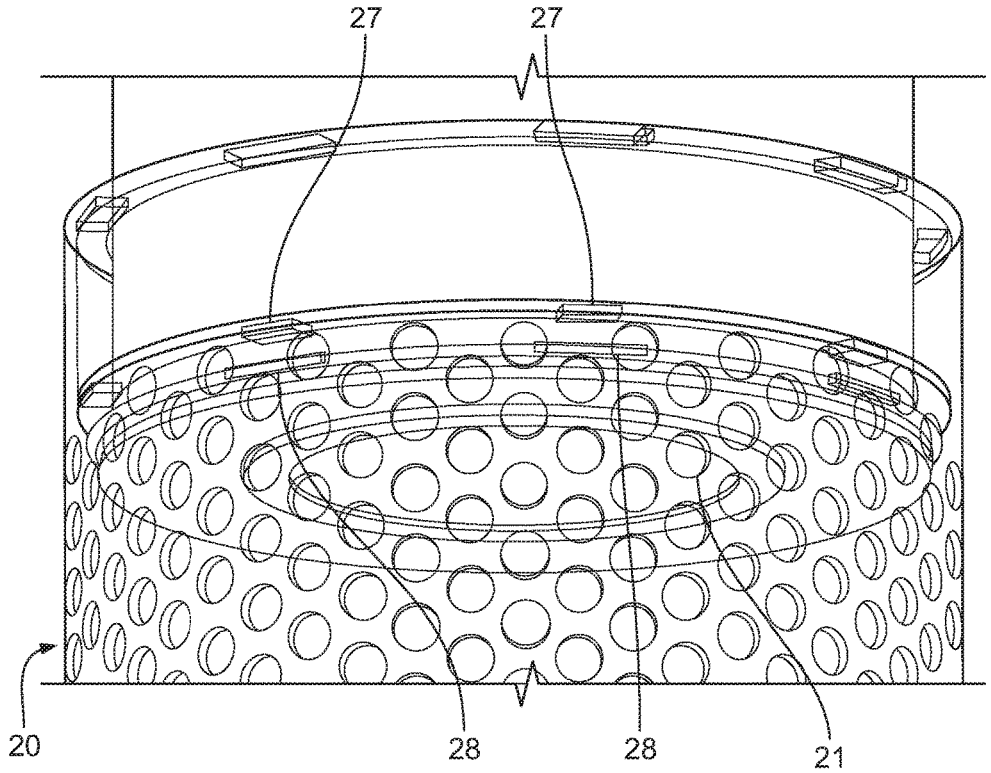
FIG. 20 is a semi-transparent partial cutaway side view of a lower portion of the speaker system in an extended configuration according to selected embodiments of the current disclosure.

FIG. 20 is a semi-transparent partial cutaway side view of a lower portion of the speaker system in an extended configuration according to selected embodiments of the current disclosure. As discussed above, the woofer 21 is raised upward as the speaker system is transitioned into an extended configuration to allow sound emanating from the woofer 21 to travel through holes in the base 20. A magnetic locking system, similar to that between the base and lid, holds the woofer plate up so that it is above the air holes in the base 20. In a particular embodiment, it holds the woofer plate four and one-half inches (4.5") above the electronics compartment of the base. Sixteen (16) magnets are provided, eight (8) magnets 27 secured to the woofer plate, and eight (8) magnets secured to the base 20. The magnetic lock between the woofer and base is easily engaged simply by lifting the speaker system into an extended configuration. This is a stable lock that is not likely disengage unless a relatively large force is exerted downward. Since the woofer plate slides up and down a wire tube, the plate cannot spin as the lid can. Therefore, disengaging this lock requires a downward force large enough to overcome the force applied by the magnets. This force is applied when the cylinders have all been collapsed as the speaker system is transitioned into a collapsed configuration. The magnetic force must be strong enough so that it will not allow the woofer to fall accidentally, but also not too strong to prevent its intentional disengagement.

Figure 21:
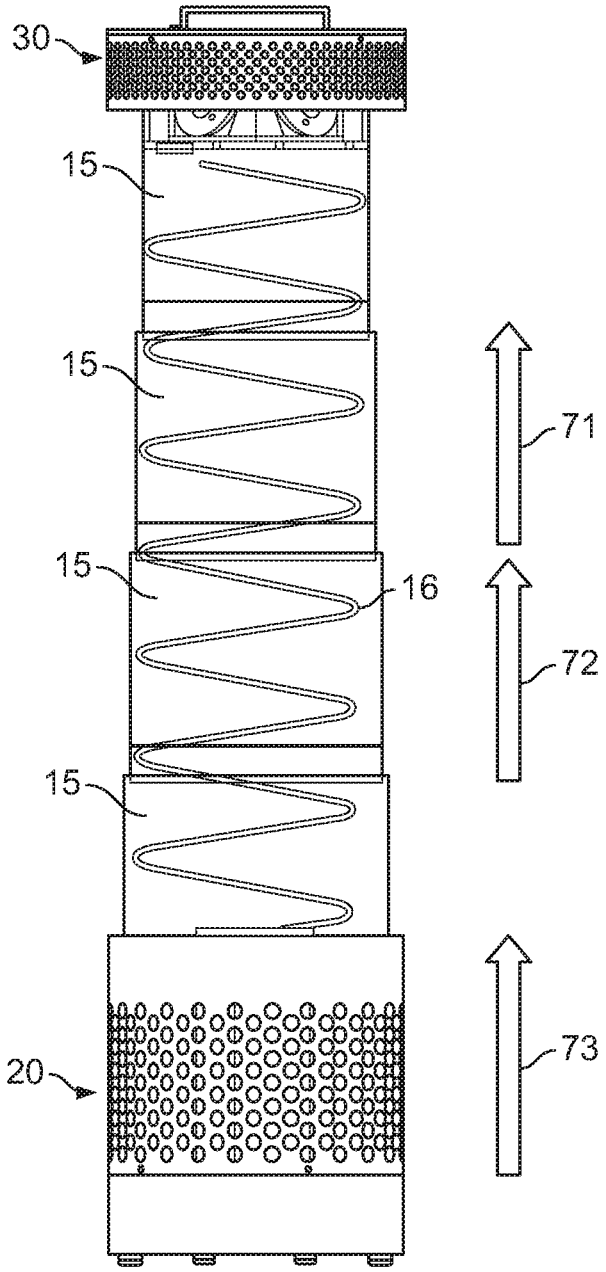
FIG. 21 is a partially semi-transparent side view of the speaker system in an extended configuration according to selected embodiments of the current disclosure.

FIG. 21 is a partially semi-transparent side view of the speaker system in an extended configuration according to selected embodiments of the current disclosure. Maintaining the system in its extended configuration, also referred to as extended state, is important since it must remain extended for long periods of time and might be leaned on by users. Three elements of the speaker system are used to maintain the speaker system in an extended configuration. As stated previously, the cylinders 15 provide a friction lock near the ends of each cylinder 15 that in effect provides a force 72 that resists movement. Also previously stated, the spring 16 provides a force 71 upwards in order to maintain extension. Both of these locks may be insufficient alone, or even in combination, because if a relatively significant amount of force is applied downward, these locks may disengage and accidentally cause the speaker system to collapse. A third lock that helps maintain the speaker system in an extended configuration is the sealed enclosure used by the woofer. By sealing the enclosure, air is prevented (or at least substantially restricted) from leaving. As a force is applied downward on the speaker system, the volume of the enclosure within the cylinders would necessarily decrease. However, since the enclosure is sealed between the cylinders and between the cylinders and base and lid, the decrease in volume also results in an increase in pressure within the enclosure. This increased pressure provides a restorative force 73 and acts to push the lid 30 away from the base 20. Since a perfect seal may not be possible, small amounts of air may be able to leak out of or into the enclosure when a force is applied. The other locking mechanisms help account for this imperfection. As discussed above, the air-seal button opens a port that provides fluid access between the enclosure within the cylinders and the environment. Thus, to collapse the speaker system and disengage the sealed enclosure lock, the air-seal button is depressed which allows air with the enclosure to escape as the speaker system is collapsed. Likewise, the air-seal button is depressed when extending the speaker system to allow air to enter the enclosure.

Particular embodiments of the current disclosure provide for a speaker system with a weight less than ten pounds (10 lbs.) due to smaller speakers and a thinner and smaller housing.

The embodiments herein have been shown using concentric collapsing cylinders: however, other cross-sectional shapes other than circles are possible, including without limitation triangles, squares, pentagons, trapezoids, and even irregular polygon or irregular curved shapes.

The bottom enclosure, or base 120, will include one subwoofer 121, six lithium-ion battery cells, and a passive crossover rigidly mounted inside an electronics compartment 140 of the base 120. The cylinders 115 when expanded will provide the volume behind the subwoofer 121 as the subwoofer 121 will be oriented downward. The top enclosure inside the lid 130 will house the tweeters 134 (speakers). An auxiliary input cable for audio input 119 will pull out from the outside of the lid 130, connecting into a headphone jack of an audio player. A power button is also present on the lid 130 of the system. The volume of the audio playback of the speaker system 100 is controlled on the user's phone or other music-playing device. The wires mn through the mechanical component of the system and integrate with the collapsing and extending mechanism through an aluminum tube that runs from the electronic components to the top of the base 120. This tube confines the wires to prevent them from getting tangled inside the system.

Figure 22:
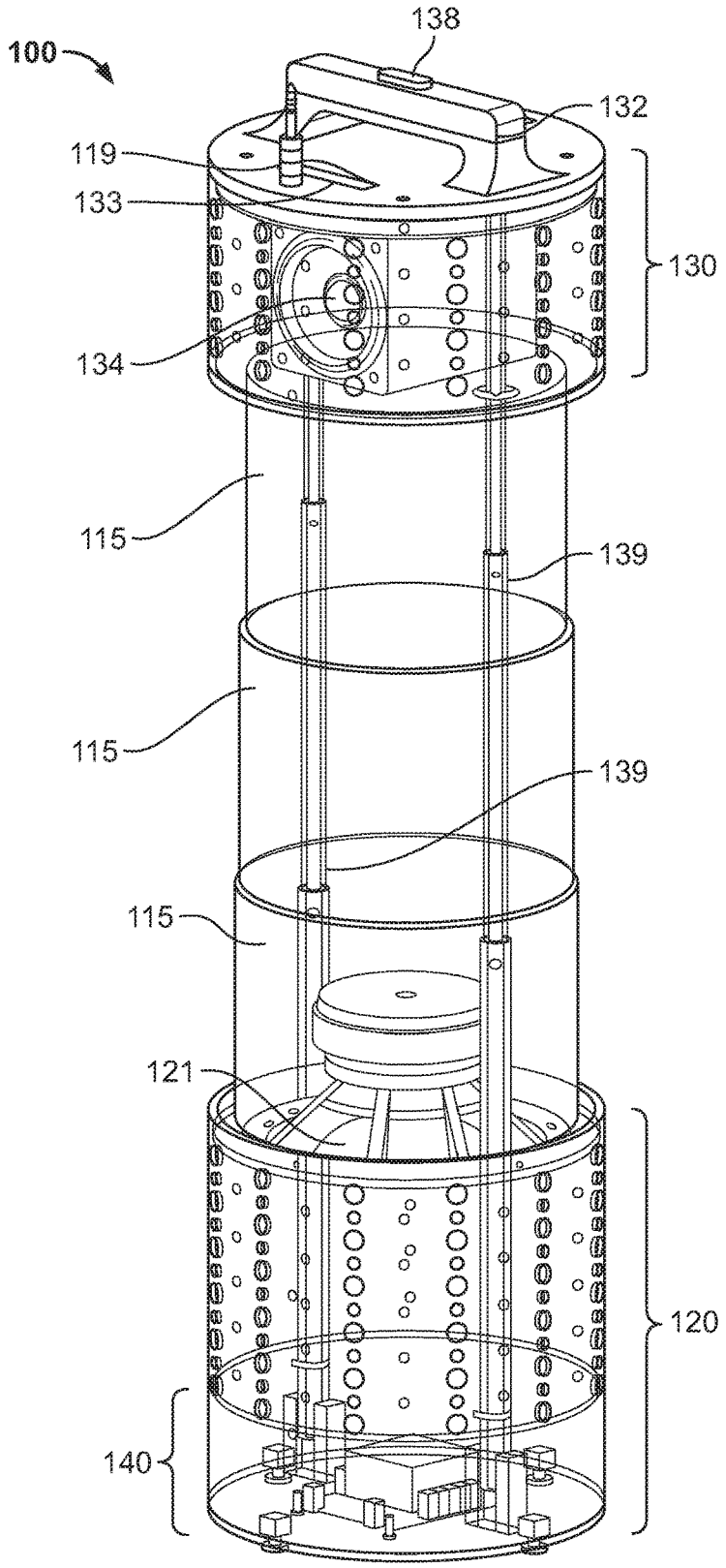
FIG. 22 is a semi-transparent view of the speaker system with a luggage extension mechanism according to selected embodiments of the current disclosure.

FIG. 22 is a semi-transparent view of the speaker system with a luggage extension mechanism according to selected embodiments of the current disclosure. Instead of a spring within the concentric cylinders, an extension mechanism, similar to what is commonly used in luggage, is incorporated into the speaker system. When collapsed, the speaker system 100 will be similar to the size of a large paint can. There will be a handle 132 on the lid 130 for the user to press down on a release button 138 and lift the handle 132 upward. The user may then pull and extend the lid 130 upward via telescopic tubing 139, also referred to as luggage extensions mechanism, and concentric cylinders 1 15. The telescopic tubing 139 will lock into place using lock pins mimicking the functionality of an extending suitcase handle. The user may compress the button 138 on the handle 132 to lower the speaker to its collapsed height and the lock pins will hold the two enclosures together.

When in a collapsed configuration, a lift force is applied by the user through the handle located on the lid. This force is transmitted through the pin lock mechanism to the base section so that the speaker system can be carried as a whole. The force that the latching mechanism must support will be the weight of the base section. The force is transferred via an internal steel pin.

Figure 23:
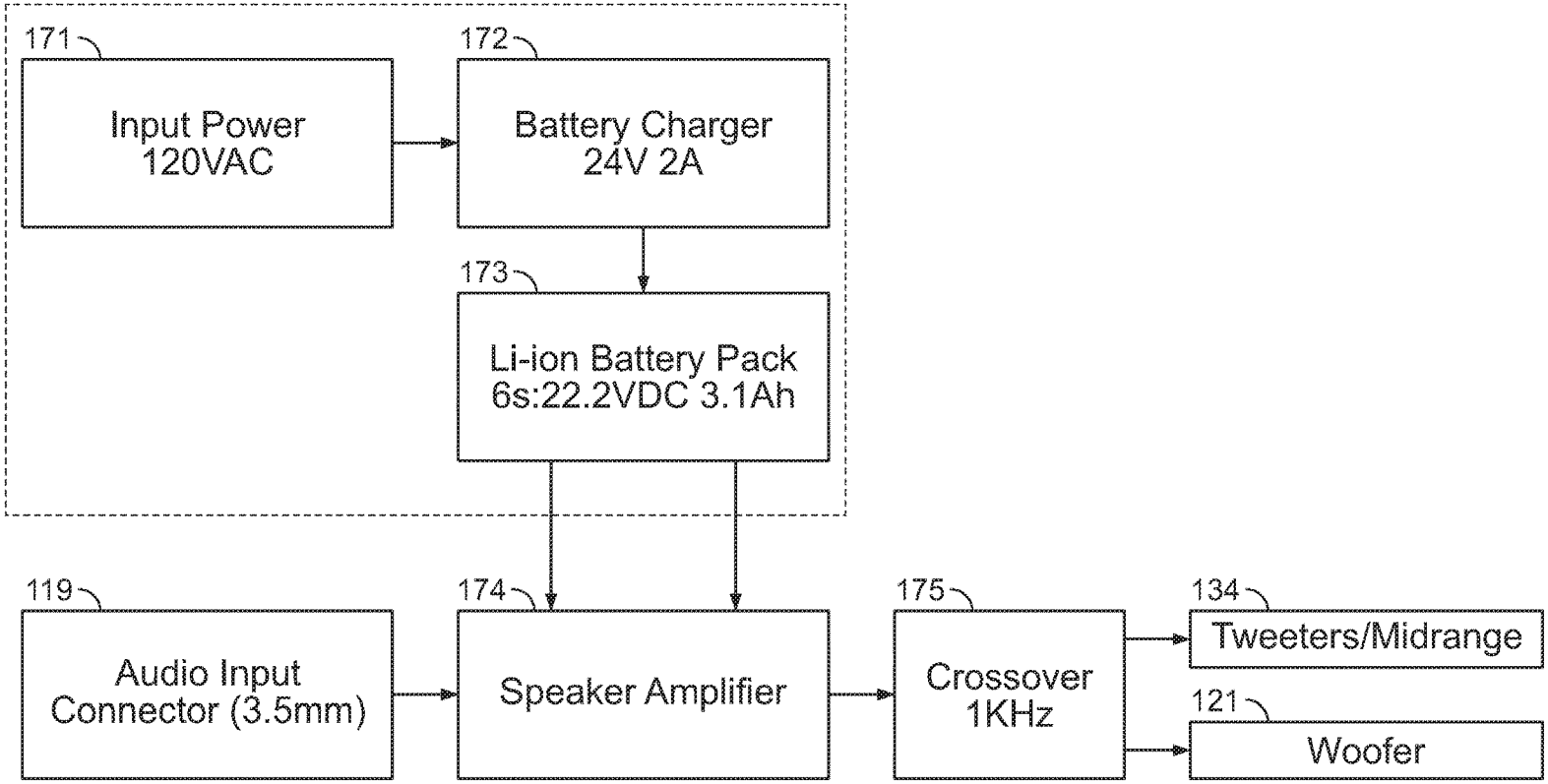
FIG. 23 is a flow chart showing the interactions of various electronic components of the speaker system according to selected embodiments of the current disclosure.

FIG. 23 is a flow chart showing the interactions of various electronic components of the speaker system according to selected embodiments of the current disclosure. A series of battery packs 173 will power the amplifier 174, the mid range or tweeter speakers 134, the woofer 121, and other electronic components such as the power button. The batteries 1 73, amplifier 1 74, and crossover 175 are stationed in the bottom of the base section, and the electronics compartment. The subwoofer 121 will be placed in the top of the base facing downward. Fourteen (14) gauge copper speaker wires will connect the electronics, subwoofer and mid range speakers in the lid with the power supply in the base. The cables will be managed through a square aluminum tube attached to the aluminum plate at the base and extending upward to the top of the bottom enclosure. The wires will mn from the electronic components through the aluminum tube up past the woofer to prevent the wires tangling or getting caught when the extension mechanism is raised and lowered. Two mid-range speakers will be mounted in the center of the lid oppositely faced with small square enclosures behind them. The woofer will have a frequency response between 20 Hz and 4500 Hz. The tweeters will have a frequency response between 2000 Hz and 20 kHz. A passive crossover, 175, which consists of a high pass filter and low pass filter will be used to prevent lower and higher frequencies from being sent to the tweeter 134 and woofer 121, respectively. A class D amplifier 174 will be used to amplify the audio signal. The audio signal will be supplied by a three and one-half millimeter (3.5 mm) auxiliary cable 119, which plugs in to the headphone port of most electronic devices. Input power 171 is supplied to a battery-charger 172, which in turn provides power to and charges a batter pack 73.

Figure 24:
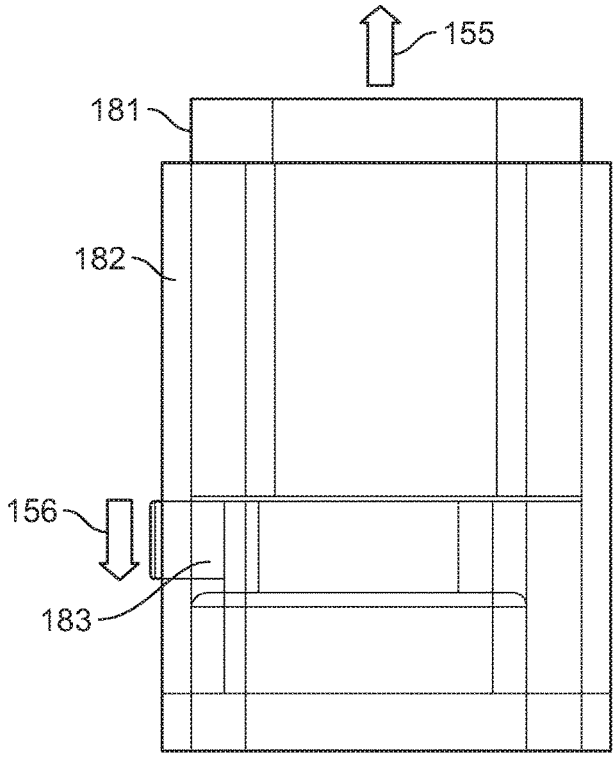
FIG. 24 is a semi-transparent partial side view of the luggage extension locking mechanism according to selected embodiments of the current disclosure.

FIG. 24 is a semi-transparent partial side view of the luggage extension locking mechanism according to selected embodiments of the current disclosure. A pin 183 extends through both the inner luggage tube 181 and outer luggage tube 82, thereby preventing one to slide relative to the other. Forces that are incident upon either tube are transferred through the pin to the other tube. For example, a carrying force 155 is transferred trough the pin to provide a support force 156 restricting the tubes from sliding relative to teach other. Therefore, the pin 183 must be able to support the force applied to either tube.

Embodiments of the speaker system will collapse and extend with the use of telescopic tubes and lock pins similar to the design of retractable luggage handles. The button on the handle will disengage and engage the lock pins in place. This design will be housed in four telescopic cylinders with an outside diameter of eight and one-quarter inches (8.25"). When collapsed, the tubing and cylinders will fit within one another inside the top enclosure within the base section.

Figure 25:
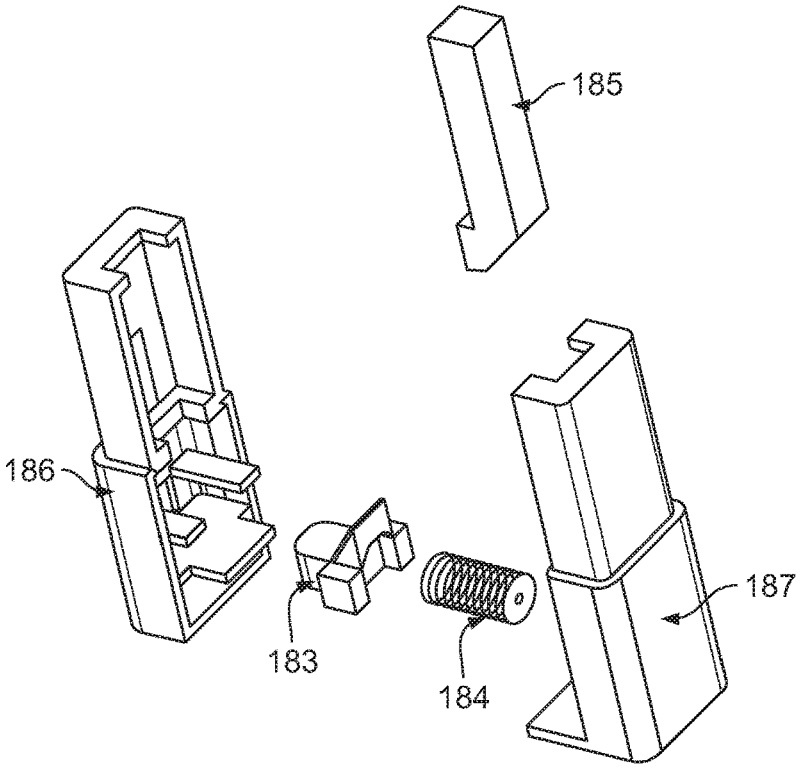
FIG. 25 is an exploded perspective view of a locking mechanism according to selected embodiments of the current disclosure.

FIG. 25 is an exploded perspective view of a locking mechanism according to selected embodiments of the current disclosure. The female housing 187 and male housing 186 form the closed housing for the lock pin components. The lock pin components include the pin 183, spring 184, and push mechanism 185.

Certain embodiments of the speaker system disclosed herein teach using a wired connection, such as a three and one-half millimeter (3.5 mm) connector, to provide an input audio signal to the speaker system. Nonetheless, other means of wired connection as well as wireless connections are possible without departing from the scope of the current disclosure. Wireless connections, such as those specified by the Bluetooth protocol, can be used in addition to or in place of a wired audio connection.

Embodiments of the speaker system with a luggage extension mechanism are held in an extended configuration using locking pins within the luggage extension mechanism. Thus, a sealed enclosure is not required to provide a force to resist compression of the enclosure. Nonetheless, a sealed enclosure for the woofer may be preferable and implemented to provide the desired audio profile. Alternatively, a ported enclosure may be implemented, whereby the enclosure is in fluid connection with the environment. Particular embodiments of the current disclosure require a durable and water resistant enclosure. To meet these requirements, the enclosure is made out of a combination of aluminum and PVC plastic.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

That which is claimed:

1. An extendable speaker system comprising:

a base comprising a first speaker;

a lid comprising a plurality of speakers; and a plurality of concentric collapsible hollow bodies, wherein the plurality of concentric collapsible hollow bodies form an enclosure above the speaker of the base and beneath the lid, wherein the plurality of concentric hollow bodies is extendable to separate the lid from the base thereby providing for an extended configuration, and wherein the plurality of concentric hollow bodies is collapsible to unite the lid with the base thereby providing for a collapsed configuration;

a spring within the enclosure; and a cable within the enclosure, and wherein the cable extends from the base to the lid, and the cable is attached to the spring at multiple locations.

2. The extendable speaker system of claim 1 wherein the enclosure is a sealed enclosure.

3. The extendable speaker system of claim 1 wherein the base further comprises a plurality of magnets, wherein the lid comprises a plurality of magnets, wherein the plurality of magnets for the base mate with the plurality of magnets of the lid when the extendable speaker system is in a collapsed configuration.

4. The extendable speaker system of claim 1 wherein the speaker of the base is a speaker with a diameter of at least four inches.

5. The extendable speaker system of claim 1 wherein the speaker of the base faces downward.

6. The extendable speaker system of claim 1 wherein each of the plurality of speakers of the lid have a diameter of two inches or less.

7. The extendable speaker system of claim 1 wherein each of the plurality of speakers of the lid has an upward angle of between ten degrees and thirty degrees, inclusive, from the horizontal.

8. The extendable speaker system of claim 1 wherein each of the plurality of speakers of the lid are offset by ninety degrees from each other.

9. The extendable speaker system of claim 1 wherein each of the plurality of hollow bodies has a lower external diameter and an upper external diameter, where the lower external diameter of each hollow body is greater than the upper external diameter of that same hollow body.

10. An extendable speaker system comprising:

a base comprising a first speaker;

a lid comprising a plurality of speakers, a port, a button, shaft, spring, and flange, where the button extends beyond a top surface of the lid, wherein the shaft is secured to the button on a first end, wherein the flange is secured to the shaft on a second end, wherein the spring surrounds the shaft, and wherein the flange releasably seals the port; and a plurality of concentric collapsible hollow bodies, wherein the plurality of concentric collapsible hollow bodies form an enclosure above the speaker of the base and beneath the lid, wherein the plurality of concentric hollow bodies is extendable to separate the lid from the base thereby providing for an extended configuration, and wherein the plurality of concentric hollow bodies is collapsible to unite the lid with the base thereby providing for a collapsed configuration;

wherein the port provides fluid access through the lid to the enclosure.

11. An extendable speaker system comprising a base, a lid, and a plurality of concentric collapsible hollow bodies, and a spring;

wherein the base comprises a speaker;

wherein the lid comprises a speaker and a port, where the port provides fluid access through the lid to the enclosure;

wherein the plurality of concentric collapsible hollow bodies form a sealed enclosure above the speaker of the base and beneath the lid, where the spring is within the enclosure, and wherein each of the plurality of concentric hollow bodies is a rigid body;

wherein the plurality of concentric hollow bodies is extendable to separate the lid from the base thereby providing for an extended configuration, and wherein the plurality of concentric hollow bodies is collapsible to unite the lid with the base thereby providing for a collapsed configuration; and wherein the cable is attached to the spring at multiple locations.

12. The extendable speaker system of claim 11 wherein the plurality of concentric hollow bodies is a plurality of concentric cylinders.

13. The extendable speaker system of claim 11 wherein each of the plurality of concentric hollow bodies comprises a lower lip and an upper lip, where the lower lip of each of the plurality of concentric hollow bodies extends outward, and where the upper lip of each of the plurality of concentric hollow bodies extends inward.

14. The extendable speaker system of claim 11 wherein the base comprises a plurality of magnets, wherein the lid comprises a plurality of magnets, where the plurality of magnets for the base mate with the plurality of magnets of the lid when the extendable speaker system is in a collapsed configuration.

15. The extendable speaker system of claim 11 wherein the base comprises a plurality of holes.

16. The extendable speaker system of claim 11 wherein the lid comprises a plurality of holes.

17. The extendable speaker system of claim 11 wherein each of the plurality of hollow bodies has a lower external diameter and an upper external diameter, where the lower external diameter of each hollow body is greater than the upper external diameter of that same hollow body.

18. The extendable speaker system of claim 11 where one end of the spring is attached to the base, and where the other end of the spring is attached to the lid.

19. The extendable speaker system of claim 11 further comprising a cable, where the cable is within the enclosure, and where the cable extends from the base to the lid.

20. The extendable speaker system of claim 11 wherein the lid further comprises a button, shaft, spring, and flange, where the button extends beyond a top surface of the lid, where the shaft is secured to the button on a first end, where the flange is secured to the shaft on a second end, where the spring surrounds the shaft, and where the flange releasably seals the port.

* * * * *